US006364173B1

(12) United States Patent
Laffey et al.

(10) Patent No.: US 6,364,173 B1
(45) Date of Patent: Apr. 2, 2002

(54) PUMP DISPENSER CLOSURE HAVING SNAP CONNECTION

(75) Inventors: Martin S. Laffey, Sylvania; Richard C. Sayers, Akron; Bradley J. Kimble, Holland; Gennaro R. Martire; Wing-Kwong Keung, both of Perrysburg, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/789,471

(22) Filed: Feb. 21, 2001

(51) Int. Cl.[7] ..... B67D 5/40
(52) U.S. Cl. ..... 222/383.1; 222/321.7
(58) Field of Search ..... 222/321.7, 321.8, 222/383.1, 568, 153.09

(56) References Cited

U.S. PATENT DOCUMENTS

| | | | | |
|---|---|---|---|---|
| 3,797,749 A | | 3/1974 | Tada | |
| 4,168,788 A | * | 9/1979 | Quinn | 222/383.1 |
| 4,361,256 A | | 11/1982 | Corsette | |
| 4,410,107 A | | 10/1983 | Corsette | |
| 4,458,832 A | | 7/1984 | Corsette | |
| 4,589,573 A | | 5/1986 | Tada | |
| 4,606,480 A | | 8/1986 | Gazalla | |
| 5,072,860 A | * | 12/1991 | Dobbs et al. | 222/383.1 |
| 5,147,074 A | * | 9/1992 | Battegazzro | 222/383.1 |
| 5,341,956 A | | 8/1994 | van Brocklin | |

* cited by examiner

*Primary Examiner*—Kevin Shaver
*Assistant Examiner*—Thach H. Bui

(57) ABSTRACT

This pump dispenser has a downward tubular support providing a lead-in for a resilient closure. The closure is formed with an upwardly facing inward lead-in chamfer and spaced deep arcuate recesses in the top surface so that the wall between the recesses and the inner diameter is outwardly resilient to permit an attachment flange to stretch the wall outward and permit snap passage of the attachment flange. In this manner the closure is permanently attached to the pump body without the need for welding or separate attaching parts.

9 Claims, 3 Drawing Sheets

PUMP DISPENSER CLOSURE HAVING SNAP CONNECTION

FIELD OF THE INVENTION

This invention relates to pump dispensers of the type having a closure attached to a container as commonly used in the dispensing of cleaners and garden chemicals. More specifically, the invention relates to a novel means for attaching the closure to the pump.

BACKGROUND OF THE INVENTION

It has been customary in the past to provide a pump dispenser body with a closure secured to the body by a flanged sleeve extending up through a hole in the closure top and welded to the body. This has involved a special part and a separate assembly operation.

In U.S. Pat. No. 4,361,259 issued Nov. 30, 1982, Douglas Corsette discloses a tubular support for a pump dispenser having an outward flange. The attaching collar has extending inward about the opening in the collar a downwardly inclined fin-like lip past which the flange snaps. When the collar is tightened on the finish, the free end of the lip presses against the root of the flange at the tubular support to effect a seal. This puts great pressure on the thin lip.

The present invention presents structure which permits snap installation of the closure over the flange on the tubular support and, at the same time, presents a downwardly facing horizontal shoulder extending inward from the body of the closure and is readily able to withstand the upward drive exerted by the finish when the collar is screwed tight.

SUMMARY OF THE INVENTION

The invention is a closure for a pump dispenser. It comprises an annular collar-like body of resilient material having an axis and an upper portion and a lower portion. The lower portion has on its interior at least one container-securing inward projection. The upper portion has an annular upper surface and an annular inward closure flange formed with an annular upwardly facing inclined lead-in chamfer and a radial bottom shoulder. The upper surface of the closure is formed with a series of spaced arcuate recesses centered on the axis and being of equal radius, the recesses being deeper than the bottom of the flange. The upper portion inward from the arcuate recesses defines an inner wall. Because of the recesses, the wall including the closure flange is sufficiently yielding to stretch outward to snap past the attaching flange on the dispenser having a diameter larger than the inner diameter of the closure flange.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
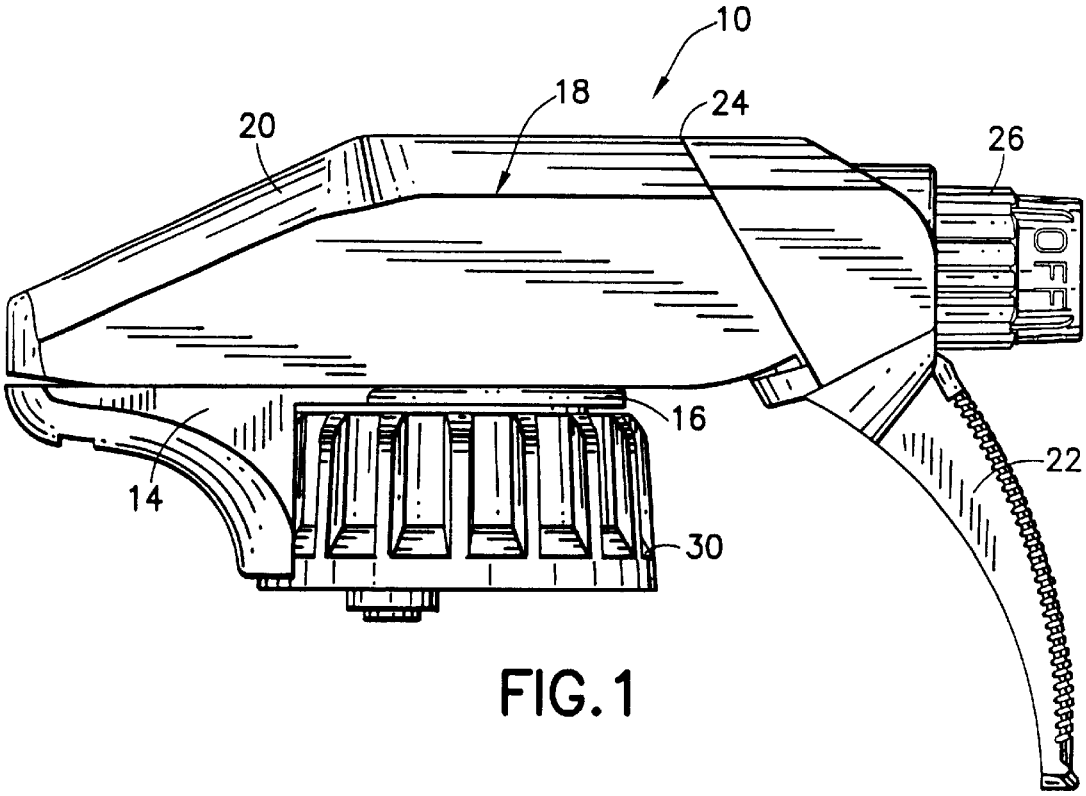
FIG. 1 is a side elevation showing a pump dispenser body with a closure embodying the invention.

FIG. 1 shows a pump dispenser body on which the closure of the invention has been assembled. The pump may be of the type disclosed in the patent application Ser. No. 09/486,887 filed Mar. 2, 2000 by Alfred von Schuckmann.

The assembly is generally designated 10 and includes a pump body 12 having a rearward shroud support 14 and a body base 16. Mounted over the pump body is the articulated cover/trigger unit 18 including the cover portion 20 and the trigger portion 22 pivotally joined by a "living" hinge 24. The pump nozzle 26 extends forward through an opening in the trigger portion 22.

A closure 30 is provided. It is of resilient plastic and comprises an annular collar-like body having an upper portion 32 and a lower portion 34. The lower portion 34 is formed on its interior with inward helical threads 36, and the upper portion has an annular upper surface 38 having an inward annular flange 40 formed with an annular upwardly facing inclined lead-in chamfer 42 and a radial bottom shoulder 44.

Figure 4:
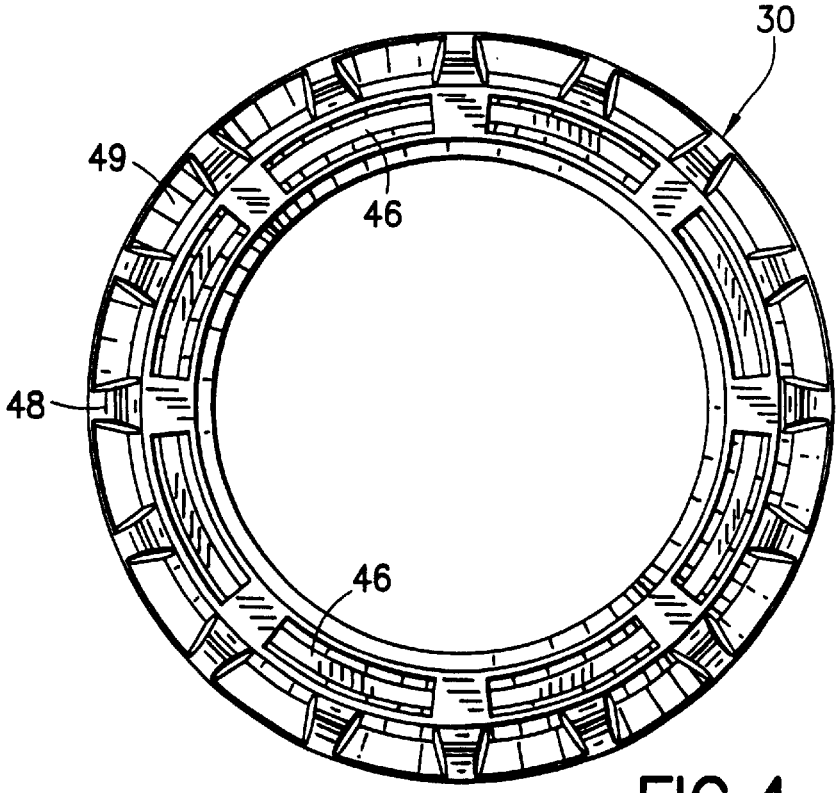
FIG. 4 is a top plan view of the closure.

The upper surface 38 is formed with a series of spaced arcuate recesses 46 centered on the axis of the annular body and being of equal radius (FIG. 4). The recesses (FIG. 2) are deeper than the bottom shoulder 44 of the flange.

Because the annular body comprising the closure 30 is of a resilient plastic, such as polypropylene, the upper portion 32 outward of the recesses 46 defining wall 45 of the top surface is able to yield outwardly as will be described.

The closure 30 is formed outwardly with a plurality of evenly spaced vertical ribs 48, every other one of which aligns as shown in FIG. 4 with the radial ribs between the recesses 46. The vertical ribs are useful for gripping purposes in screwing the closure on the finish of the container. At its lower end the body is formed with a continuous peripheral rib 49 which provides a smooth transition to the usual bottom flange of the finish (not shown), having approximately the same diameter.

Figure 2:
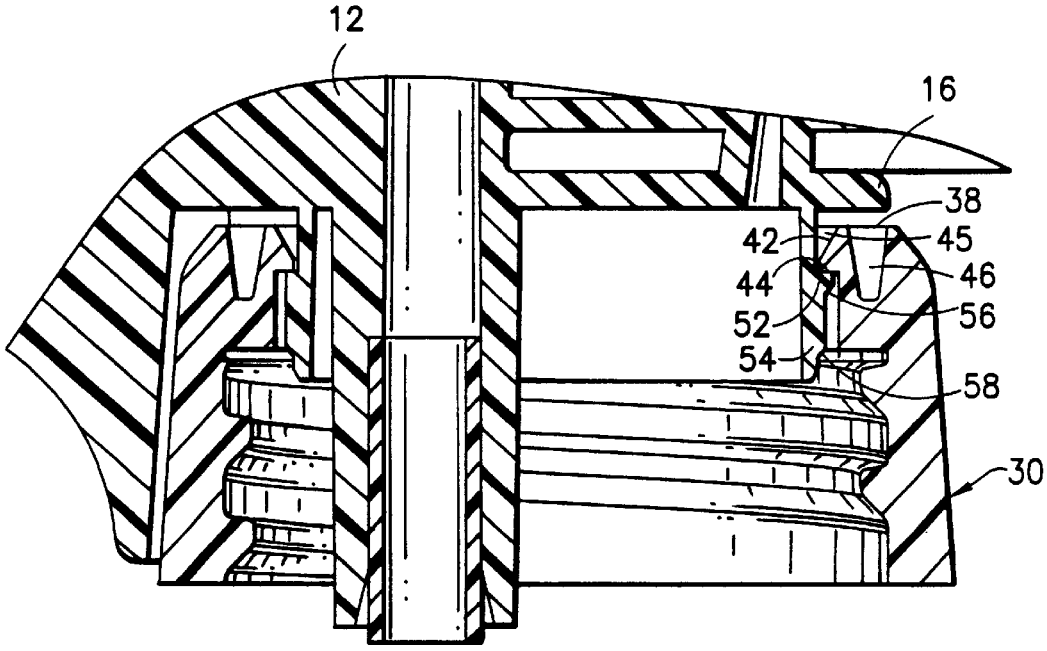
FIG. 2 is a fragmentary sectional view taken through the bottom of the dispenser body and closure.
Figure 3:
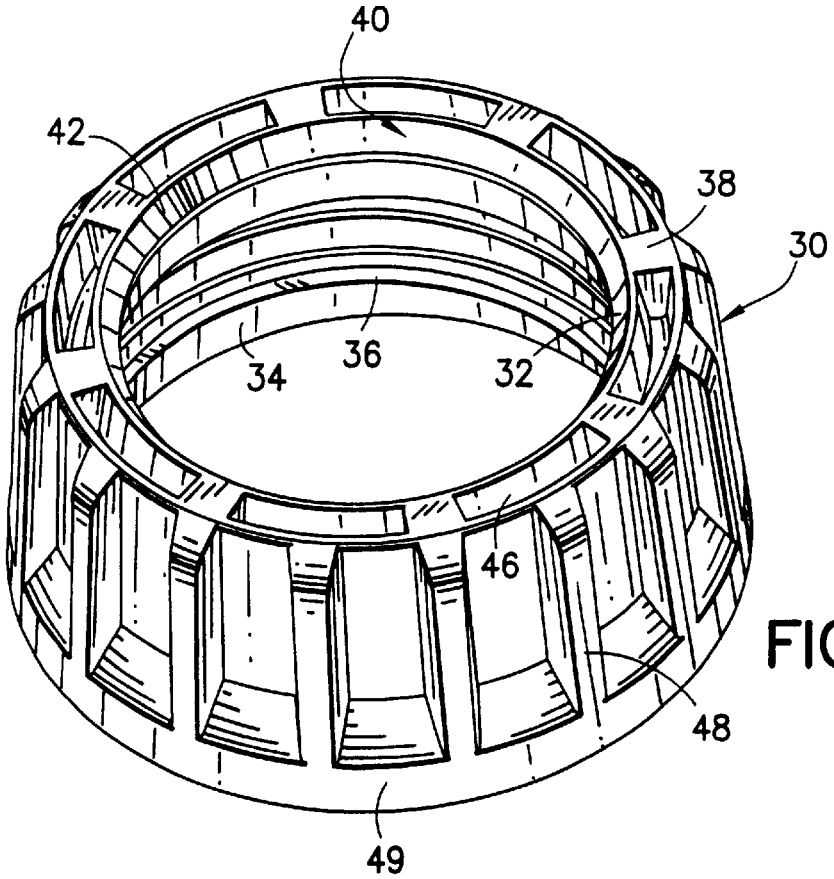
FIG. 3 is a perspective view of the closure.
Figure 5:
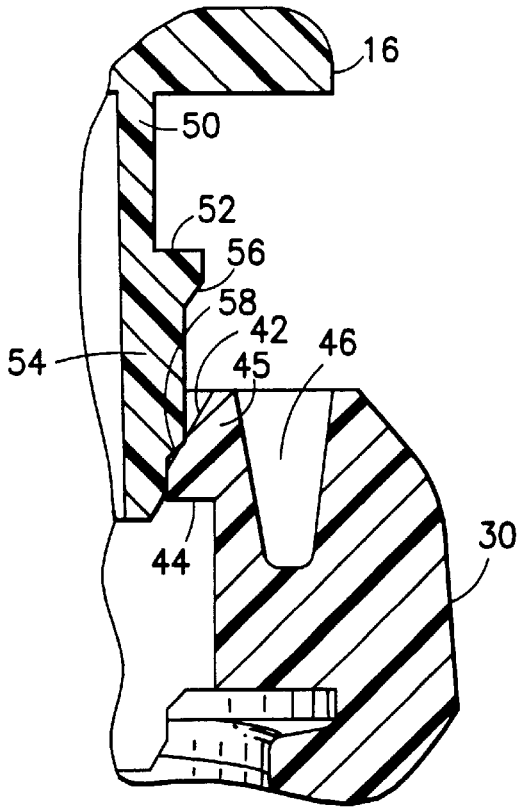
FIGS. 5, 5A and 5B are fragmentary sectional views of a portion of the closure and dispenser body progressively showing the installation process.
Figure 5A:
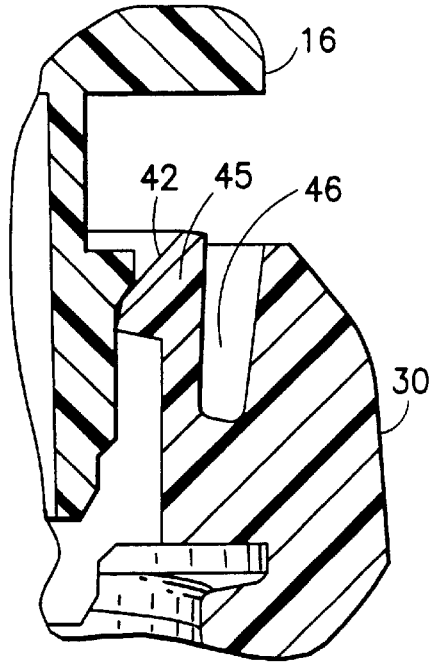
Figure 5B:
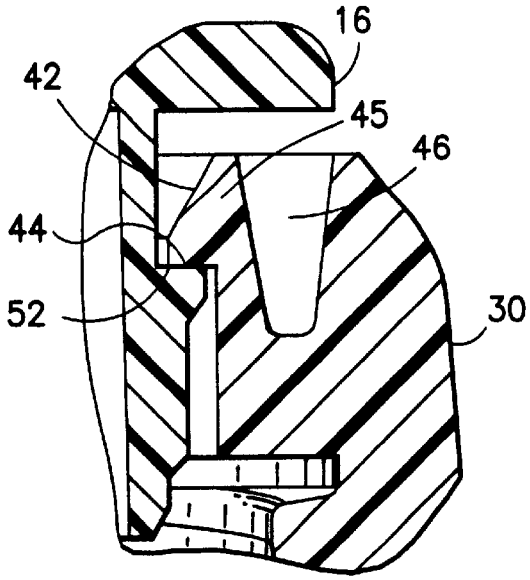

FIGS. 2, 5, A and 5B make clear the attachment of the dispenser body to the closure. More specifically, the body is formed with a downward tubular support barrel 50 which is provided with an outward upward annular ledge 52. Below ledge 52 the barrel is formed with a thickened area 54 and an outward chamfer 56 to serve as a lead-in. A chamfer 58 is formed on the barrel to seal against the inside edge of the bottle finish.

In assembly the lower end of the barrel is introduced to the lead-in chamfer 42 which spreads the inner wall 45 inside the recesses 46. This spreading is further achieved as the chamfer 56 meets and rides over the inlet chamfer 42 of the closure. When the barrel is pressed into the closure, the wall snaps inward over the ledge 52 on the barrel to secure the closure onto the pump in non-removable fashion. The chamfer 58 seals against the inside edge of the bottle finish when the assembly is installed on the bottle (not shown).

By virtue of this structure, it is unnecessary to provide any attachment techniques which have taken time and expense in the past. At the same time, the sturdy downward shoulder 44 extending inward from the wall of the closure is rigid enough to withstand the upward force of the finish. The closure of the present invention freely rotates on the pump dispenser body to permit the installation of the closure on the finish.

Further variations in the invention are possible. For instance, the ribs 48 may be reduced in number or eliminate to afford greater flexibility to the wall 45 and still provide some of the benefits of the invention. Thus, while the invention has been shown in limited embodiments, it is not so limited but is of a scope defined by the following claim language which may be broadened by an extension of the right to exclude others from making, using or selling the invention as is appropriate under the doctrine of equivalents.

What is claimed is:

1. A closure for a pump dispenser comprising an annular body of resilient material having an axis and an upper portion and a lower portion, the lower portion on its interior having at least one container-securing inward projection, the upper portion having an annular upper surface and an annular inward closure flange formed with an annular inwardly and downwardly inclined lead-in chamfer and a radial downward shoulder, the upper surface being formed with a series of spaced arcuate recesses centered on the axis and extending downward to a level below the shoulder, the upper portion inward from the arcuate recesses being sufficiently yielding to permit the flange to stretch outward to snap past an attachment flange having a diameter larger than the inner diameter of the closure flange.

2. A closure cap as claimed in claim 1 wherein the inward projection of the lower portion is at least a partial helical thread.

3. A closure cap as claimed in claim 1 wherein the body is formed with spaced outward ribs parallel to the axis.

4. A closure cap as claimed in claim 3 wherein the outward ribs align with spaces between the spaced arcuate recesses.

5. A pump dispenser comprising a pump body having a downward tubular support formed with an outward attachment flange having a diameter, a closure comprising an annular body of resilient material having an axis and an upper portion and a lower portion, the lower portion on its interior having at least one container-securing inward projection, the upper portion having an annular upper surface and an annular inward closure flange formed with an annular inwardly inclined lead-in chamfer and a radial bottom closure shoulder, the upper surface being formed with a series of spaced arcuate recesses centered on the axis and being of equal radius, the recesses extending down to a level deeper than the bottom shoulder of the closure flange, the closure flange encircling the tubular support and having its bottom shoulder engaging the outward base attachment flange of the pump body.

6. A pump dispenser as claimed in claim 5 wherein the inward projection of the lower portion is at least a partial helical thread.

7. A pump dispenser as claimed in claim 5 wherein the closure is formed with spaced outward ribs parallel to the axis.

8. A pump dispenser as claimed in claim 7 wherein the outward ribs align with spaces between the spaced arcuate recesses.

9. A process for assembling a pump dispenser comprising:

a. providing a pump dispenser body having a tubular support encircled by a n attachment flange, b. providing a closure for a pump dispenser comprising an annular body of resilient material having an axis and an upper portion and a lower portion, the lower portion on its interior having at least one container-securing inward projection, the upper portion having an annular upper surface and an annular inward closure flange having an inner diameter and formed with an annular inwardly and downwardly inclined lead-in chamfer and a radial downward shoulder, the upper surface being formed with a series of spaced arcuate recesses centered on the axis and extending downward to a level below the shoulder, the upper portion inward from the arcuate recesses being sufficiently yielding to permit the flange to stretch outward to snap past an attachment flange having a diameter larger than the inner diameter of the closure flange, and c. inserting the tubular support into the closure to cause the attachment flange to engage the chamfer, and d. pressing the tubular support farther into the closure so that the closure flange stretches and the attachment flange snaps past the closure flange.

* * * * *